US012721384B2

(12) United States Patent
Deurloo et al.

(10) Patent No.: US 12,721,384 B2
(45) Date of Patent: Sep. 1, 2026

(54) LOWER BODY GARMENT WITH ACCESSIBLE POCKETS

(71) Applicant: LULULEMON ATHLETICA CANADA INC., Vancouver (CA)

(72) Inventors: Willem Jacob Deurloo, Vancouver (CA); Evan Alexandro Caballero, Vancouver (CA); Eliot Jean Cohen Pirenne, Vancouver (CA)

(73) Assignee: Lululemon Athletica Canada Inc., Vancouver (CA)

( * ) Notice: Subject to any disclaimer, the term of this patent is extended or adjusted under 35 U.S.C. 154(b) by 69 days.

(21) Appl. No.: 18/797,858

(22) Filed: Aug. 8, 2024

(65) Prior Publication Data

US 2026/0041174 A1 Feb. 12, 2026

(51) Int. Cl.

| | |
|---|---|
| ***A41D 1/089*** | (2018.01) |
| ***A41D 27/02*** | (2006.01) |
| ***A41D 27/20*** | (2006.01) |

(52) U.S. Cl.

CPC ..... *A41D 1/089* (2018.01); *A41D 27/02* (2013.01); *A41D 27/20* (2013.01)

(58) Field of Classification Search

CPC ..... A41D 1/08; A41D 1/089; A41D 13/0015; A41D 27/02; A41D 27/20; A41D 27/201; A41D 27/204; A41D 27/207; A41D 27/22; A41D 2600/10

USPC ..... 2/228, 247

See application file for complete search history.

(56) References Cited

U.S. PATENT DOCUMENTS

| | | | | |
|---|---|---|---|---|
| 4,771,478 | A * | 9/1988 | Bisagno | A45F 5/02 2/919 |
| 5,636,386 | A * | 6/1997 | Salamone | A41D 1/14 2/243.1 |
| 2007/0050890 | A1* | 3/2007 | Purnell | A41F 9/025 2/235 |
| 2010/0281595 | A1* | 11/2010 | Gernes | A41B 9/001 2/69 |
| 2013/0283494 | A1* | 10/2013 | Vaughn | A41D 1/14 2/69 |
| 2015/0082516 | A1* | 3/2015 | Doan | A41D 27/20 2/220 |
| 2015/0216245 | A1* | 8/2015 | Kinsley | A41D 1/08 2/237 |
| 2016/0295933 | A1* | 10/2016 | Herbener | A63B 47/001 |
| 2017/0318868 | A1* | 11/2017 | Luong | A41D 27/245 |
| 2017/0354192 | A1* | 12/2017 | Albano | A41D 27/207 |
| 2021/0235792 | A1* | 8/2021 | Rea | A41D 27/201 |

(Continued)

*Primary Examiner* — Matthew R Marchewka

(74) *Attorney, Agent, or Firm* — Norton Rose Fulbright Canada LLP; Thomas Sutherland

(57) ABSTRACT

Garments with inner liner pocket access through the outer shell without the need to lift the shell to access the pocket, including a lower body garment including an inner liner, a pocket, and an outer shell, are described. A first pair of leg portions of the inner liner is configured to cover a pelvic portion and a leg portion of the wearer. The pocket has a pocket bag formed by attaching a pocket panel on the inner liner. The body of the outer shell includes a second pair of leg portions configured to cover the pelvic portion and the leg portion of the wearer. A portion of the inner liner is visible through the outer shell at a pocket opening. The pocket panel is attached to a portion of the top edge of the outer shell, such that the pocket is accessible from the visible portion of the inner liner.

19 Claims, 6 Drawing Sheets

(56) References Cited

U.S. PATENT DOCUMENTS

| | | | | |
|---|---|---|---|---|
| 2022/0015482 | A1* | 1/2022 | Vysotska | A41D 27/205 |
| 2024/0373959 | A1* | 11/2024 | Aihara | A41D 27/205 |
| 2025/0098802 | A1* | 3/2025 | Anson | A41D 27/201 |

* cited by examiner

LOWER BODY GARMENT WITH ACCESSIBLE POCKETS

FIELD

The present disclosure generally relates to the field of garments and in particular lower body garments.

BACKGROUND

Typical garments designed to be worn on a wearer's lower body (e.g., pants, shorts, skirts, etc.) often incorporate pockets so that the wearer can carry small objects (e.g., wallets, keys, phones, etc.) without using their hands or carrying an additional article, such as a purse or backpack. Shorts may have pockets on an inner liner and a wearer needs to lift a shell from the bottom and pull it up to access the pocket, exposing the liner and showing part of the leg and raising modesty concerns. There exists a need for construction of run shorts with pockets to prevent awkward and unwanted situations when modesty is required.

SUMMARY

Provided herein are garments constructed such that the user may access an inner liner pocket through the outer shell of the garment without the need to lift the shell from the bottom and pull it up.

According to an aspect, there is provided a lower body garment. The lower body garment includes a waistband configured to be positioned around a waist of a wearer, an inner liner comprising a first pair of leg portions having a first pair of bottom leg openings, a pocket comprising a pocket bag, and an outer shell comprising a top edge and a body. The waistband includes an upper edge and a lower edge. The upper edge of the waistband defines a waist opening. The first pair of leg portions covering a pelvic portion and a leg portion of the wearer. The first pair of leg portions are configured to be positioned around legs of the wearer. An upper edge of the inner liner is attached to the lower edge of the waistband. The pocket bag formed by attaching a pocket panel on at least one of the first pair of leg portions of the inner liner. The pocket panel includes at least one open edge and at least one closed edge. The at least one closed edge of the pocket panel is attached to the inner liner forming the pocket bag with a pocket opening at the at least one open edge. At least a portion of the top edge of the outer shell is attached to at least a portion of the lower edge of the waistband and at least a portion of the upper edge of the inner liner. The body of the outer shell includes a second pair of leg portions having a second pair of bottom leg openings. The second pair of leg portions covering the pelvic portion and the leg portion of the wearer. The body of the outer shell substantially engulfs a portion of the inner liner covering the pelvic portion of the wearer. The second pair of leg portions encase the first pair of leg portions, such that a portion of the inner liner is visible at least at the pocket opening. The open edge of the pocket panel is attached to a portion of the top edge of the outer shell that is aligned with the pocket opening, such that the pocket is accessible from the visible portion of the inner liner, via the pocket opening.

In some embodiments, the pocket bag is formed such that the pocket opening is formed on at least one of the first pair of leg portions and is proximate to the upper edge of the inner liner.

In some embodiments, a diameter of each leg opening of the first pair of bottom leg openings is smaller than a diameter of each leg opening of the second pair of bottom leg openings.

In some embodiments, the lower body garment further includes an accessory loop on the waistband of the lower body garment.

In some embodiments, the lower body garment further includes at least one pocket located on the inside of a rear side of the inner liner.

In some embodiments, the inner liner is made of a mesh material.

In some embodiments, a length of the first pair of leg portions is different from a length of the second pair of leg portions.

In some embodiments, a portion above the pocket opening is not engulfed by the outer shell.

In some embodiments, the portion above the pocket opening is made of at least two layers of fabric.

In some embodiments, the inner liner is made of elastic mesh material.

In some embodiments, the inner liner is made of a material that has a higher level of compressibility than a compressibility level of a material that the outer shell is made of.

In some embodiments, the lower body garment includes two pockets, one positioned on a left leg portion and the other positioned on the right leg portion of the first pair of leg portions.

In some embodiments, the two pockets are positioned on sides of each of the leg portions of the first pair of leg portions.

In some embodiments, the waistband further includes a drawcord positioned on an interior side of the waistband for tensioning the waistband.

In some embodiments, the lower body garment further includes a drawcord pouch positioned on an interior side of the inner liner.

In some embodiments, the inner liner further includes a pouch positioned in the pelvic portion of the inner liner such that the drawcord is inserted in the pouch to keep it hidden.

In some embodiments, the lower body garment is one or more of a short, pant, trouser, legging, cropped pant, skirt, or skort.

In some embodiments, the pocket further includes a gripping surface formed on an inner surface of the pocket bag.

In some embodiments, the at least one closed edge includes a bottom edge and opposing side edges of the pocket panel and the at least one open edge comprises a top edge. The bottom edge and opposing side edges of the pocket panel are attached to the inner liner forming the pocket bag with an upward facing pocket opening.

Many further features and combination thereof concerning embodiments described herein will appear to those skilled in the art following a reading of the instant disclosure.

DESCRIPTION OF THE FIGURES

The accompanying drawings are fully incorporated in, and form part of, this specification, and illustrate embodiments of the invention that, together with the description, explain principles of the invention.

DETAILED DESCRIPTION

Reference will now be made in detail to embodiments of the invention, examples of which are illustrated in the accompanying drawings. While the invention is described in conjunction with these embodiments, it will be understood that the descriptions herein are not intended to limit the invention to these embodiments. On the contrary, the invention is intended to cover alternatives, modifications, and equivalents that may be included within the spirit and scope of the invention as defined by the appended claims. Detailed description of components that are well known in the art may be omitted if that detailed description would confuse or obscure the description of the embodiments of the present invention.

Directional terms such as "top", "bottom", "front", "back", "upper", "lower", "outer" and "inner" are used in the following description for the purpose of providing relative reference only and are not intended to suggest any limitations on how any article or garment is to be positioned during use, or to be mounted in an assembly or relative to an environment. The use of the word "a" or "an" when used herein in conjunction with the term "comprising" may mean "one", but it is also consistent with the meaning of "one or more", "at least one" and "one or more than one". Any element expressed in the singular form also encompasses its plural form. Any element expressed in the plural form also encompasses its singular form. The term "plurality" as used herein means more than one, for example, two or more, three or more, four or more, and the like.

The term "substantially" as used herein may be applied to modify any quantitative representation which could permissibly vary without resulting in a change in the basic function to which it is related.

The present disclosure relates to lower body garments, such as shorts, having structured pockets. The lower body garment described herein comprises of an inner liner and an outer shell. In a preferred embodiment, pockets are constructed on the inner liner with a pocket opening which can be accessed from the outer shell. The pockets can be positioned on a right leg or left leg of a wearer or on both legs of the wearer. The inner liner and the outer shell may be in form a short, pant, trouser, legging, cropped pant, skirt, or skort.

Figure 1B:
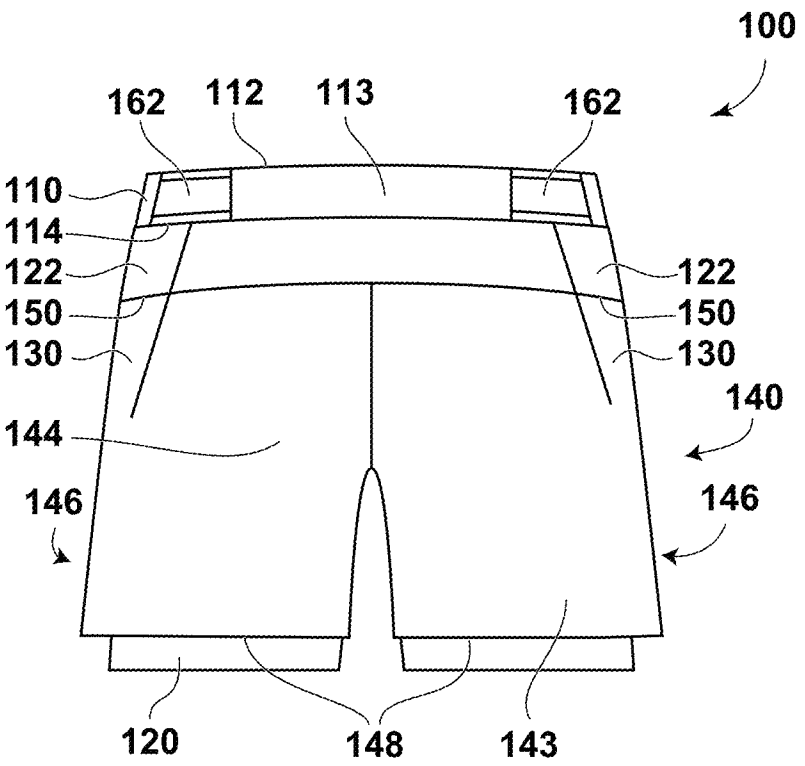
FIG. 1B illustrates a rear view of an exemplary garment, according to an embodiment of the present invention.
Figure 1A:
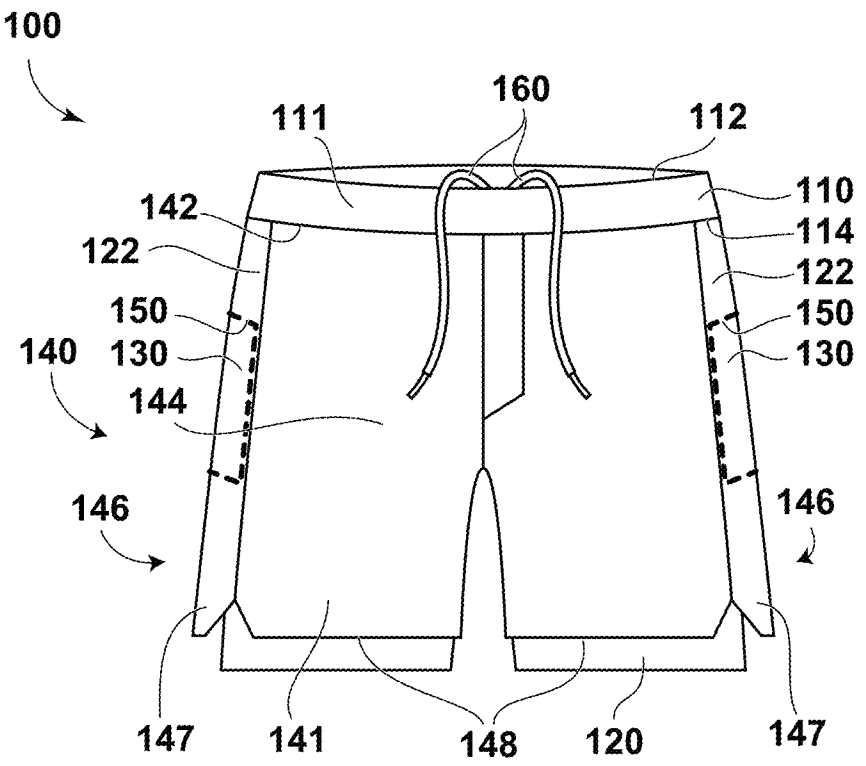
FIG. 1A illustrates a front view of an exemplary garment, according to an embodiment of the present invention.

FIG. 1A and FIG. 1B illustrates a garment 100, such as, for example a shorts, with emphasis on an outer shell 140, according to some embodiments.

FIG. 1A illustrates a front view of the garment 100. FIG. 1B illustrates a rear view of the garment 100. As shown in FIG. 1A and FIG. 1B, the garment 100 comprises of the outer shell 140, an inner liner 120, a waistband 110, drawcord(s) 160, pocket(s) 130, double panel(s) 122, and accessory loop(s) 162. The waistband 110 is configured to be positioned around a waist of the wearer. The waistband 110 further comprises of an upper edge 112 and a lower edge 114. The upper edge 112 defines a waist opening of the garment 100. The outer shell 140 comprises of a upper edge 142 and an outer shell body 144. The outer shell body 144 can include an outer shell front panel 141, an outer shell rear panel 143, side panel(s) 147 and pocket access 150. While the outer shell 140 shown includes an outer shell body 144 with an outer shell front panel 141, an outer shell rear panel 143, and side panel(s) 147, in some embodiments, the outer shell body 144 may be fabricated from fewer panels (e.g., only an outer shell front panel 141 and an outer shell rear panel 143 or one continuous panel) or more panels (e.g., there may be a medial side panel to further define the crotch region of the garment 100 or other panels).

Figure 2B:
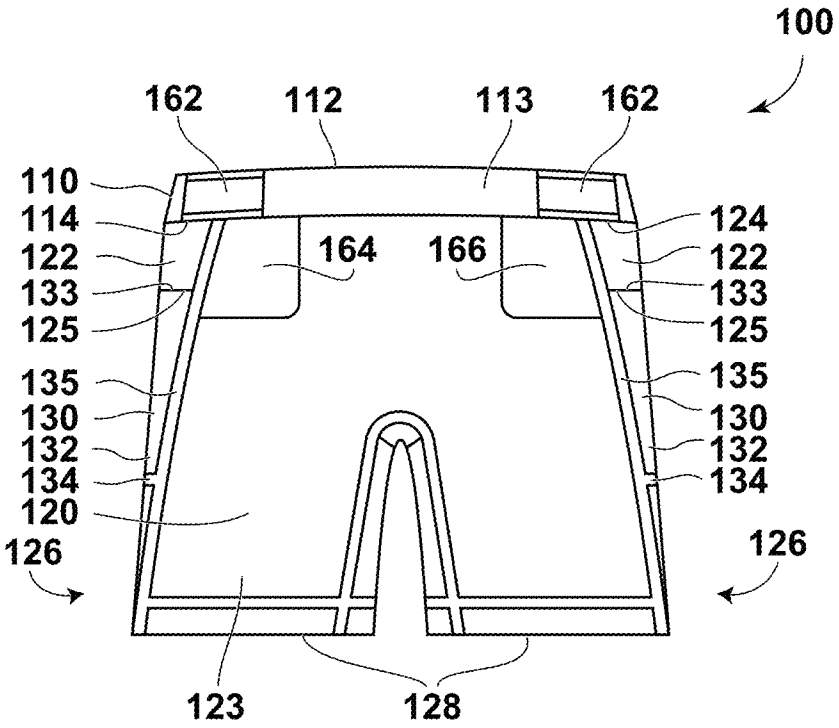
FIG. 2B illustrates a rear view of an inner liner of an exemplary garment, according to an embodiment of the present invention.
Figure 2A:
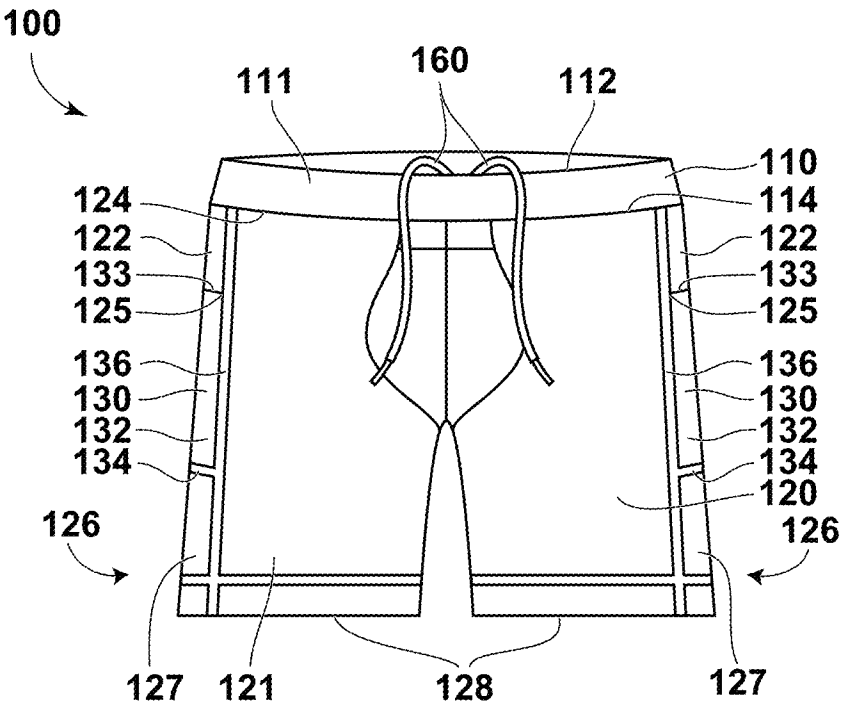
FIG. 2A illustrates a front view of an inner liner of an exemplary garment, according to an embodiment of the present invention.

FIG. 2A and FIG. 2B illustrates the garment 100 with emphasis on the inner liner 120. FIG. 2A illustrates a front view of the inner liner 120 of garment 100 showing a front panel 121 of the inner liner 120. FIG. 2B illustrates a rear view of the inner liner 120 of garment 100 showing a rear panel 123 of the inner liner 120. As shown in FIG. 2A and FIG. 2B, the garment 100 comprises the inner liner 120 that may include the front panel 121 of the inner liner 120, rear panel 123 of the inner liner 120, side panel(s) 127 of the inner liner 120, pocket panel(s) 132 (more clearly visible in FIG. 4) forming pocket(s) 130, upper edge 133 of pocket panel 132, lower edge 134 of pocket panel 132, side edges 135 and 136 of pocket panel 132, pocket opening 125, double panel(s) 122, and inner liner back pockets 164 and 166. The upper edge 124 of the inner liner 120 is attached along the lower edge 114 of the waistband 110. While the inner liner 120 shown includes a front panel 121, rear panel 123, and side panel(s) 127, in some embodiments, the inner liner 120 may be fabricated from fewer panels (e.g., only a front panel 121 and a rear panel 123 or one continuous panel) or more panels (e.g., there may be a medial side panel to further define the crotch region of the garment 100 or other panels). Furthermore, the inner liner 120 and the outer shell 140 may have different numbers of panels (e.g., the inner liner 120 may include more panels to apply different compression to different regions of the wearer while the outer shell 140 may be made up of, for example, two panels to simplify manufacturing).

A front portion of the garment 100 comprises of the front panel 121 of the inner liner 120, the front panel 141 of the outer shell 140, front portion 111 of the waistband 110, drawcords 160, drawcord pouch 168 (described in greater detail below) and genitalia containment pouch 169 (described in greater detail below) located on the inside of the inner liner 120. A rear portion of the garment 100 comprises of the rear panel 123 of the inner liner 120, the rear panel 143 of the outer shell 140, rear portion 113 of the waistband 110, accessory loops 162 and inner liner back pockets 164, 166 located on the inside of the inner liner 120. A side portion of the garment 100 comprises of side panel 127 of the inner liner 120, side panel 147 of the outer liner 140, pocket panel 132, pocket 130, pocket access 150, pocket opening 125, double panel 122, and side portion 117 of the waistband 110.

The outer shell 140 as seen in FIG. 1A and FIG. 1B, is constructed such that, a front portion of the upper edge 142 of the outer shell 140 is attached (e.g., bonded, stitched, or otherwise connected) to a front part of the waistband 110 along the lower edge 114 of the waistband 110. In a preferred embodiment, the front portion of the upper edge 142 of the outer shell 140 may also attached to a front portion of the upper edge 124 of the inner liner 120, forming the front panel 141 of the outer shell 140. A rear portion of the outer shell 140 is attached (e.g., bonded, stitched, or otherwise connected) to a rear part of the waistband 110 along the lower edge 114 of the waistband 110. In a preferred embodiment, the rear portion of the outer shell 140 may also attached to a rear portion of the upper edge 124 of the inner liner 120, forming the rear panel 143 of the outer shell 140. Pocket(s) 130, constructed on the inner liner 120, can be accessed using pocket access 150. The outer shell 140 encapsulates a portion of the inner liner 120. In some embodiments, the front portion of the upper edge 142 and the rear portion of the outer shell 140 may not be attached to the inner liner 120.

The outer shell 140 also comprises of side panels 147 on left and right sides of the garment 100 connecting the front panel 141 to the rear panel 143. In a preferred embodiment, the pocket access 150 is constructed on the side panels 147 of the outer shell 140 of the garment 100. The pocket(s) 130 may be accessed from the pocket access 150.

The outer shell 140 as seen in FIG. 1A and FIG. 1B, is constructed such that, a portion of the upper edge 142 of the left side panel 147 of the outer shell 140 is attached to the top edge 133 of a left side pocket panel 132. A portion of the upper edge 142 of the right side panel 147 of the outer shell 140 is attached to the top edge 133 of a right side pocket panel 132. The area where the portion of the upper edge 142 of the left side panel 147 and of the right side panel 147 of the outer shell 140 is attached to the top edge 133 of a pocket panel 132, is defined as the pocket access 150. The wearer may be able to access the pocket 130 using the pocket access 150. The pocket access 150 may comprise of either of a space, gap, slit, cut, vent, opening, space or aperture to access pocket(s) 130. In the present embodiment, the left side portion and the right side portion of the upper edge 142 of the outer shell 140 is not attached to the lower edge 114 of the waistband 110. The left side portion and the right side portion of the upper edge 142 of the outer shell 140 in the embodiment shown in FIG. 1A and FIG. 1B, is attached to the upper edge 133 of the pocket panel 132 creating unobstructed access space 150 (also referred to as pocket access 150) to access the pocket(s) 130 formed in the inner liner 120.

The inner liner 120 is constructed such that it has a first pair of leg portions 126 (made up of, for example, portions the front panel 121, the rear panel 123, and the respective side panel 127) having a first pair of bottom leg openings 128 for the wearer's legs. The wearer may put the garment on by inserting their legs in the first pair of leg openings 128 and pulling the garment 100 up, such that the upper edge 112 of the waistband 100 rests on the wearer's waist. The first pair of leg portions 126 on the inner liner 120 cover the pelvic portion and the leg portion of the wearer, conforming to the body of the wearer.

The outer shell 140, as seen in FIG. 1A and FIG. 1B, is constructed such that it has a second pair of leg portions 146 (made up of, for example, portions the front panel 141, the rear panel 143, and the respective side panel 147) having a second pair of bottom leg openings 148 for the wearer's legs. The second pair of leg openings 148 is constructed around the first pair of leg openings 128, thus covering the first pair of leg openings 128 of the inner liner 120. At the pocket opening 125, the second pair of leg portions 146 of the outer shell 140 do not cover the first pair of leg portions 126 of the inner liner 120.

Figure 4:
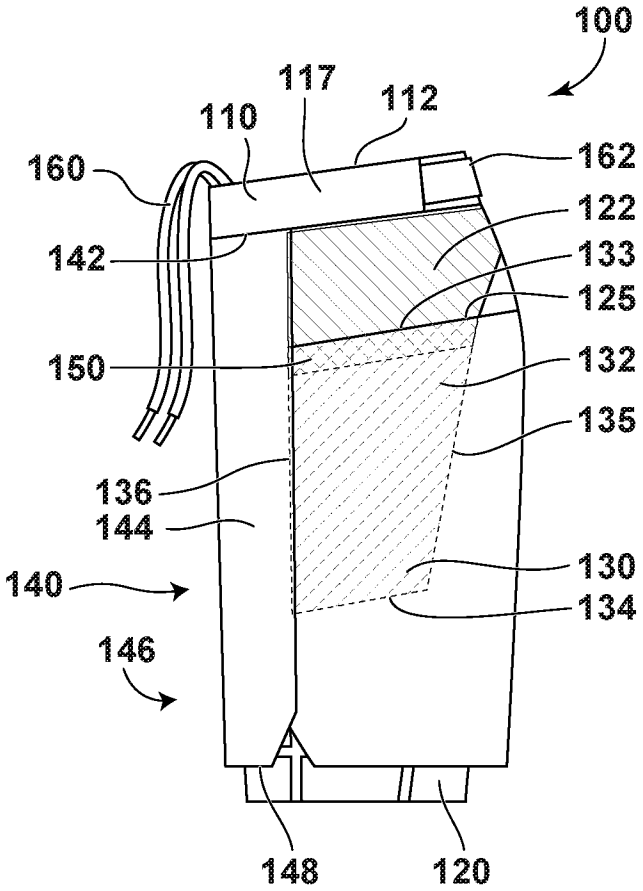
FIG. 4 illustrates a side view of an exemplary garment, according to an embodiment of the present invention.
Figure 3:
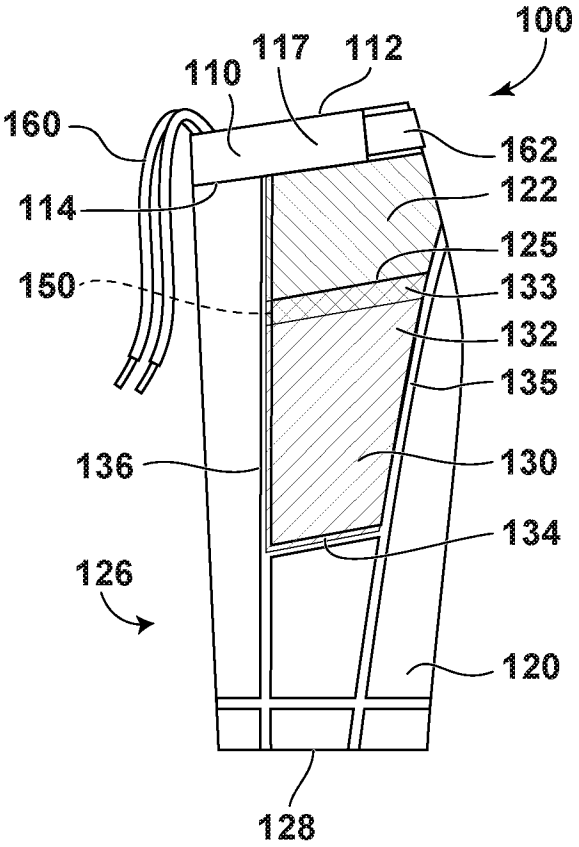
FIG. 3 illustrates a side view of an inner liner of an exemplary garment, according to an embodiment of the present invention.

FIG. 3 and FIG. 4 illustrate a side view of the garment 100 showing side panels of the garment 100. FIG. 3 shows the side panel 127 of the inner liner 120 of the garment 100, according to an embodiment of the present invention. FIG. 4 illustrates a side panel 147 of the outer shell 140 of the garment 100, according to an embodiment of the present invention.

The pocket 130 of the garment 100 comprises of a pocket bag formed by attaching the pocket panel 132 on at least one of the first pair of leg portions 126 on the side panel 127 of the inner liner 120. The pocket 130 may be constructed on the right leg side panel 127 or left leg side panel 127 or both side panels 127 of the wearer. The pocket panel 132 comprises of the upper edge 133, the lower edge 134 and the side edges 135 and 136. The pocket bag is formed by attaching the lower edge 134 and opposing side edges 135 and 136 of the pocket panel 132 to the side panel 127 of the inner liner 120. The upper edge 133 of the pocket panel 132 is not attached to the side panel 127 of the inner liner 120 forming the pocket opening 125 to access the pocket bag. The construction of the pocket bag with the unattached upper edge 133, forms an upward facing pocket 130. The upper edge 133 of the pocket panel 132 is attached to a portion of the upper edge 142 of the outer shell 140 forming the unobstructed access 150.

The pocket 130 of the garment 100 can provide ready access to the wearer to the contents of the pocket 130 without the need to lift the outer shell 140 of the garment 100. This can provide pocket access in a more convenient manner for the wearer. This can also obviate the need to lift the outer shell 140 and expose the inner liner 120 which might give rise to modesty concerns. The outer shell 140 may also expose at least a portion of the inner liner 120 above the pocket access 150. This may aide the wearer in identifying and accessing the pocket 130 without looking down or stopping an activity (e.g., running). For example, the wearer can feel for the exposed inner liner 120 and slip their hand into the pocket access 150. In some embodiments, the double panel 122 may help identify the pocket access 150.

FIG. 3 and FIG. 4 also show double panel 122. Double panel 122 is positioned above the pocket 130 on the side panel 127 of the inner liner 120. The lower edge of the double panel 122 is positioned right along the upper edge 133 of pocket panel 132 on the side panel 127 of the inner liner 120.

The double panel 122 may provide coverage to the wearer without the coverage provided by the outer shell 140. For example, if the inner liner 120 is made of a mesh or a semi-transparent (when worn) material, then by providing the double panel 122, the wearer's skin under the double panel 122 may be covered while still providing the double panel 122 for easy access to the pocket 130. In some embodiments, other techniques may be employed to provide coverage. For example, the region referred to as the double panel 122 may make use of an opaque (when worn) material.

In still other embodiments, the outer shell 140 may also obscure the region referred to as the double panel 122.

Figure 5B:
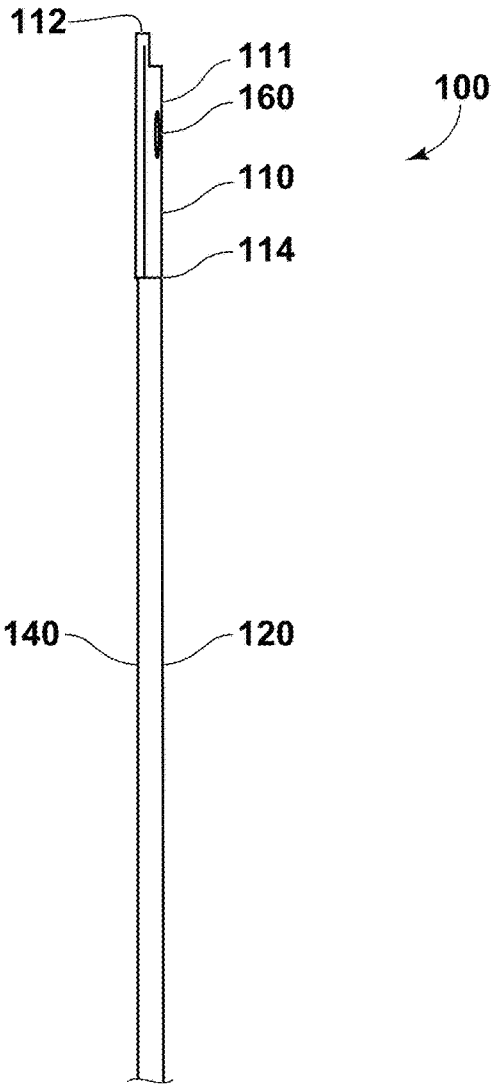
FIG. 5B illustrates a partial cross section view of an exemplary garment, according to an embodiment of the present invention.
Figure 5A:
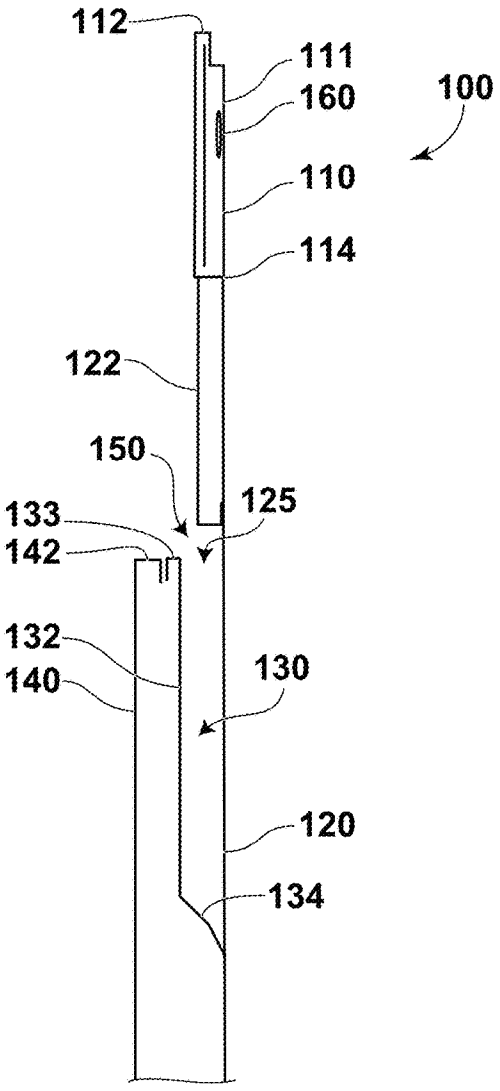
FIG. 5A illustrates a partial cross section view of an exemplary garment, according to an embodiment of the present invention.

FIG. 5A and FIG. 5B illustrate a partial cross section view of an exemplary garment 100, according to an embodiment of the present invention. FIG. 5A illustrates a cross section of the side portion of the garment 100 where the pocket 130 is constructed and FIG. 5B illustrates a cross section of the front or rear portion of the garment 100 where there is no pocket construction.

As seen in FIG. 5A, the pocket 130 is constructed using pocket panel 132. In a preferred embodiment, the pocket access 150 is located on the outer shell 140, from where the wearer will access the pocket 130. However, the actual pocket bag is constructed on the inner liner 120, using pocket panel 132, as described above. In the preferred embodiment the outer shell 140 only create unobstructed access space 150 to access the pocket 130. Pocket 130 and pocket opening 125 are constructed on the inner liner 120.

The pocket bag is formed on the side panel 127 of the inner liner 120 by attaching the lower edge 134 and opposing side edges 135 and 136 of the pocket panel 132 to the side panel 127 of the inner liner 120. The upper edge 133 of the pocket panel 132 is not attached to the side panel 127 of the inner liner 120 forming the pocket opening 125. The construction of the pocket bag with the unattached upper edge 133 of the pocket liner 120, forms an upward facing pocket 130. The upper edge 133 of the pocket panel 132 is attached along the upper edge 142 of the outer liner 140 forming access 150 such that the side panel 147 of the outer shell 140 does not cover the pocket opening 125 allowing unobstructed and easy access to the pocket 130, using the access 150, without lifting the outer shell 140. The lower edge 114 of waistband 110 is attached along the upper edge 124 of the inner liner 120.

A portion of the side panel 147 of the outer shell 140 can be attached (e.g., bonded, stitched, or otherwise connected) to a portion of the side panel 127 of the inner liner 120, such that a portion of the inner liner 120 is exposed. This exposed portion of the inner liner is the double panel 122. The lower edge 114 of the waistband 110 is also attached along the upper edge of the double panel 122. The lower edge of the double panel 122 is attached to the side panel 127 of the inner liner 120, right above the upper edge 133 of the pocket panel 132, where the pocket 130 is constructed. In the preferred embodiment, the side panel 147 of the outer shell 140 encapsulates the side panel 127 of the inner liner 120 everywhere, except at the pocket opening 125 and the double panel 122. The exposure of the inner liner 120 at the double panel 122 makes it easy for the wearer to access the pocket 130 using access space 150. The wearer does not need to lift the outer shell 140 to get to pocket 130. Lifting the outer shell 140, to access pocket 130 while actively participating in any activity may be a hassle for the wearer. Lifting the outer shell 140 to access the pocket 130 may also raise modesty concerns for the wearer. Access to the pocket 130 through pocket access 150 makes it easy and comfortable for the wearer to access objects stored within the pocket 130.

Other constructions of the pocket bag are also possible without deviating from the teachings herein.

Double panel 122 is the exposed portion of the inner liner 120, which is not encapsulated by the outer shell 140. In some embodiments, the upper edge 142 of the outer shell 140 runs along the lower edge 114 of the waistband 110 everywhere, except in the pocket area where it is attached along the upper edge 133 of the pocket panel 132 to create space for accessing the pocket 130.

The double panel 122 is constructed using at least two layers of fabric. Two layers of fabric are used to protect the modesty of the wearer. The fabric used for construction of the double panel 122 may be the same as the fabric used for the construction of the inner liner 120. In some embodiments, the fabric used for the construction of the double panel 122 may be different than the fabric used for the construction of the inner liner 120. In some embodiments, the entire inner liner 120 may be constructed using at least two layers of fabric.

Figure 6:
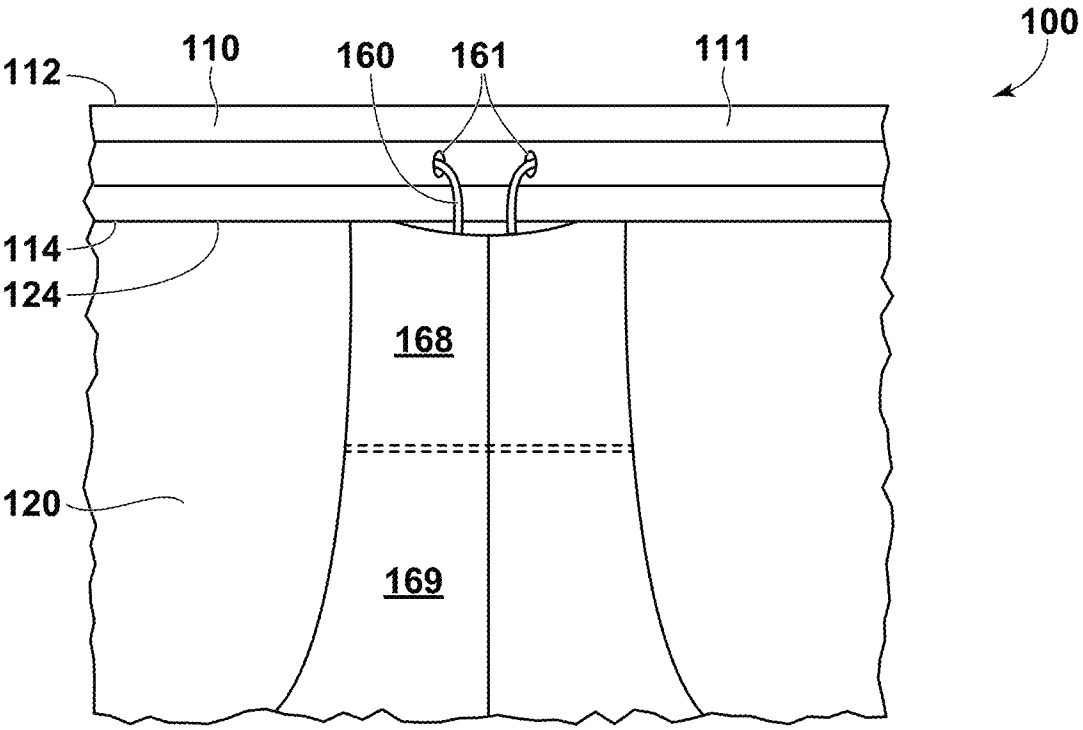
FIG. 6 illustrates a partial interior view of an exemplary garment showing a drawcord pouch, according to an embodiment of the present invention.

FIG. 6 illustrates partial interior view of an exemplary garment 100, according to an embodiment of the present invention. The garment 100 can include a drawstring or drawcord 160 for tightening the waistband 110 of the garment 100 against the waist of the wearer. The drawcord 160 may be positioned or encased in fabric on the inside of the garment 100 in between the upper edge 112 and the lower edge 114 of the waistband 110. The drawcord 160 may come out of the encased fabric from the openings 161. When out, the wearer can pull the drawcord 160 to tighten the waistband 110. The garment 100 may also include a drawcord pouch 168 to insert the drawstring 160. Drawcord 160 if left on the outside of the garment 100 may distract the wearer while performing an activity (e.g., running), or if left unrestricted on the inside, may touch the wearer making them uncomfortable. Drawcord pouch 168 restricts the movement of the drawcord 160 so that it does not touch or distract the wearer. The drawcord pouch 168 may be constructed by attaching a panel, a flap, a mesh, or other structures on the interior surface of the front panel 121 of the inner liner 120. The drawcord pouch 168 may be attached right under the drawcord openings 161. The drawcord pouch 168 may be attached under the lower edge 114 of waistband 110. Alternatively, it may be attached to the lower edge 114 of waistband 110.

In some embodiments, the interior of the front panel 121 of the inner liner 120 may additionally or alternatively include a genitalia containment pouch 169. The genitalia containment pouch 169 may be constructed for use by a male identifying person, that is, a person having a penis and a scrotum. The genitalia containment pouch 169 may be constructed by attaching a panel, a flap, a mesh, or other structures on the interior surface of the front panel 121 of the inner liner 120. The purpose of the genitalia containment pouch 169 is to cup the genitalia, isolating the genitalia from coming in contact with inner thighs and legs of the wearer, improving comfort, airflow, and support for the genitalia. In some embodiments, the genitalia containment pouch 169 may be constructed using same material as the inner liner 120. In other embodiments the genitalia containment pouch 169 may be constructed using a different material than the inner liner 120. The material used to construct the genitalia containment pouch 169 may include moisture wicking fabric, spandex (e.g., LYCRA®), mesh, or any other material.

In some embodiments, the waistband 110 may comprise any of a variety of suitable closure techniques, including but not limited drawstring, snap, zipper, etc. and/or can include elastic to provide for a desired fit around the waist of the user.

Figure 7B:
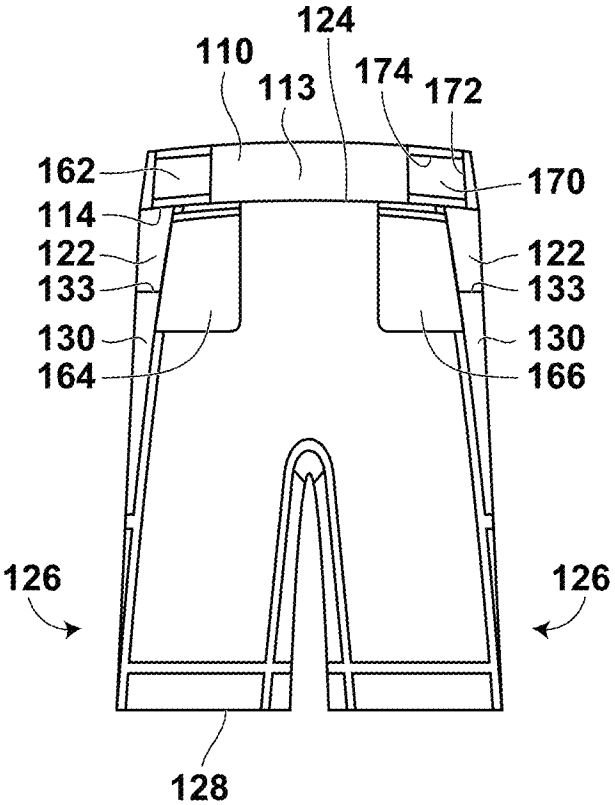
FIG. 7B illustrates a partial interior view of the exemplary garment with back pockets provided thereon, according to an embodiment of the present invention.
Figure 7A:
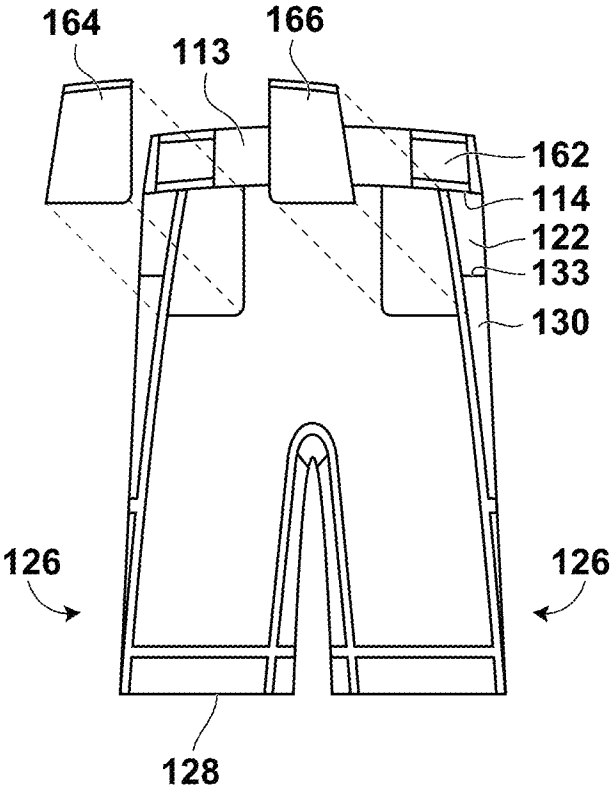
FIG. 7A illustrates a partial interior view of an exemplary garment with back pockets exploded out, according to an embodiment of the present invention.

FIG. 7A illustrates a partial interior view of a rear portion of the garment 100 with back pockets 164 and 166 exploded out, according to an embodiment of the present invention. FIG. 7B illustrates a partial interior view of a rear portion of the garment 100 with back pockets 164 and 166 provided thereon, according to an embodiment of the present invention. FIG. 7A and FIG. 7B show the inside of the rear panel 123 of the inner liner 120. The inside of the rear panel 123 of the inner liner 120 comprises of at least one additional pocket 164 or 166. As seen in FIG. 7A and FIG. 7B, the inside of the rear panel 123 of the inner liner 120 has two back pockets 164 and 166 proximate to the side panel 127 of the inner liner 120. Inner liner back pockets 164 and 166 may be constructed by attaching a panel, a flap, a mesh, or other structures on the interior surface of the rear panel 123 of the inner liner 120. Inner liner back pockets 164 and 166 are proximate to the lower edge 114 of the rear portion 113 of waistband 110. Openings of inner liner back pockets 164 and 166 are located on an upper end of the pockets 164 and 166, proximate to the lower edge 114 of the rear portion 113 of waistband 110. The size of the inner liner back pockets 164 and 166 may vary based on the type of lower body garment 100. For example, if the lower body garment 100 is a short, the inner liner pockets 164 and 166 may be smaller than pocket(s) 130. If the lower body garment 100 is a full pant or a legging, the inner liner back pockets 164 and 166 may be of the same size as pocket(s) 130. In some embodiments, an opening may be provided in the outer shell 140 to provide the wearer with access to back pockets 164 and 166.

The waistband 110 also comprises of at least one accessory strap or accessory loop 162. As seen in FIG. 7A and FIG. 7B, the exemplary garment 100 may comprise of two accessory loops 162 on the rear portion 113 of the waistband 110. The accessory loops 162 may be located on of the rear portion 113 of waistband 110 proximate to the side portion of garment 100. Alternatively, the accessory loops 162 may be located anywhere on the front portion 111 or rear portion 113 or both the front portion 111 and the rear portion 113 of the waistband 110. Alternatively, or additionally, the accessory loops 162 may be located anywhere on the side portion 117 of the waistband 110. These accessory loops 162 may be made of elastic strap 170. The material used for construction of the accessory loops 162 may be same as the waistband 110 or may be different than the material used to construct waistband 110. The elastic strap 170 may have two short sides 172 facing each other and two long sides 174 facing each other. Short side 172 is perpendicular to long side 174. The two short sides 172 of the elastic strap may be attached to the rear portion 113 of the waistband 110 forming a loop 162 such that the two long sides 174 of the elastic trap remain unattached. When the wearer uses the garment 100 for an activity (e.g., running), the wearer might have a need to carry a towel. The wearer may insert a small towel through the loop 162 created by the unattached long sides 174 of the elastic strap 170 to secure the towel or any other accessory while running. The wearer may take the towel out, use it and insert it back through the loops 162 comfortably without having to pause or take a break from the activity. In some alternative embodiments, the accessory loops 162 may be positioned anywhere on the waistband 110. In some embodiments, the two long sides 174 may be attached to the waistband 110 while the two short sides 172 remain unattached forming a loop on the waistband 110. In some embodiments, the inner liner 120 may conform to the body of the wearer from the waist to above the knees. In some embodiments, a diameter of the first pair of bottom leg openings of the inner liner 120 is smaller than a diameter of the second pair of bottom leg openings of the outer shell 140. In this case, the inner liner 120 may be in contact with the wearer's legs while the outer shell 140 may float away from the wearer's legs.

The inner liner 120 may be a full-length pant or a crop length pant or legging. In some embodiments, the first pair of leg portions of the inner liner 120 are of a length such that, when the wearer is standing still, the first pair of leg portions of the inner liner 120 are not visible due to the presence of the second pair of leg portions on the outer shell 140. In other embodiments, the inner liner 120 may be longer than the outer shell 140, where the first pair of leg portions of the inner liner 120 are visible from under the second pair of leg portions on the outer shell 140. In other embodiments the inner liner 120 may be of the same length or slightly shorter than the outer shell 140. In some embodiments, the inner liner 120 may extend from the waistband up to or above the wearer's knees (e.g., for shorts). In some embodiments, the inner liner 120 may extend from the waistband well below the knee (e.g., for a full pant, a legging, a crop pant, or any style pant).

In some embodiments, the outer shell 140 may be constructed using a single piece of fabric used to construct the front panel 141, rear panel 143 and the side panel(s) 147. In other embodiments, to reduce wastage and promote sustainable fashion, different pieces of the fabric may be attached (e.g., bonded, stitched, or otherwise connected) to each other to construct front panel 141, rear panel 143 and the side panel(s) 147 of the outer shell 140. In some embodiments, the outer shell 140 may have additional panels on the rear, sides or the front. In some embodiments the outer shell 140 may be constructed to include the additional panels using a single piece of fabric. In other embodiments, the outer shell 140 may be constructed to include the additional panels using different pieces of fabric attached (e.g., bonded, stitched, or otherwise connected) to each other forming the outer shell 140.

In some embodiments, the outer shell 140 may encapsulate the inner liner 120 entirely except for the double panel 122. In other embodiments, the outer shell 140 may encapsulate the inner liner 120 in its entirety. The side panel 147 of the outer shell 140 encapsulates the side panel 127 of the inner liner 120 everywhere, except at the pocket opening 125. In this case, the pocket opening 125 may be the only portion of the inner liner 120 that may be visible from the outside. In other embodiments, outer shell 140 may encapsulate the inner liner such that some portion of the first pair of leg portions 126 of the inner liner 120 may be exposed. The outer shell 140 may be in the form a short, pant, skirt, or skort, and may be a discontinuous or integral part of an upper body garment (e.g., a dress, jumpsuit, etc.).

In some embodiments, the outer shell 140 and inner liner 120 may be optionally completely attached along the lower edge 114 of waistband 110, without exposing the double panel 122. The outer shell 140 may comprise of pocket access slit(s) formed in the outer shell 140 that is in alignment with the pocket opening(s) 125 to allow access to the pocket opening 125 and in turn the pocket(s) 130.

In some embodiments, a gripping surface may be formed on an inner face of the pocket panel 132, so that when an item is inserted into the pocket(s) 130, it is adhered to the griping surface preventing bouncing action of such item within the pocket(s) 132. In one embodiment, the gripping surface can comprise at least one silicone strip formed on the inner face of the pocket panel 132. In another embodiment, the gripping surface can comprise several silicone dots formed of the inner face of the pocket panel 132. In some embodiments, the gripping surface can be formed on the inner face of the pocket panel 132 in proximity to the entrance opening. Alternatively, or additionally, in some embodiments, gripping surface may be formed on the outer surface of the inner liner 120 where the pocket panel 132 is attached to the inner liner 120.

In some embodiments, the inner liner 120 may be constructed using a fabric engineered such that the inner liner 120 has multiple compression zones. The compression provided by each of the compression zones may be different to provide higher compression in areas where greater support is required and lower compression in areas where greater mobility is required. Different levels of spandex (e.g., LYCRA®) content (or similar synthetic fibers or yarn such as elastane, polyamide, polyether-polyurea copolymer, etc.) may be engineered into the fabric of the inner liner 120 to create different compression zones. Mesh textures for ventilation zones may also be included.

In some embodiments, pocket(s) 130 may be used for storing objects, for example, snacks, phones, cameras, keys, or cards. In some embodiments, pocket(s) 130 are configured to have a certain shape, elasticity, location, or the like, to keep the objects in a desired position relative to the wearer. In some embodiments, the pocket(s) 130 or inner liner back pockets 164 and 166 may be used for storing objects to assist with the thermoregulation of the wearer (e.g., to assist with heating or cooling), for example, ice, ice cubes, ice packs, gel packs, air-activated heat pack, supersaturated solution heat pack (snap and heat), or battery-powered heat pack. In some embodiments the inner liner back pockets 164 and 166 may be located in the interior region of the front panel 121 of the inner liner 120. In some embodiments the inner liner back pockets 164 and 166 may be located in the interior of the side panels 127 of the inner liner 120.

The pocket(s) 130, the inner liner 120 and the outer liner 140 described may be formed of a fabric or material suitable for apparel, for example a woven, nonwoven, knit, mesh, or the like.

In some embodiments, the material of the outer shell 140 may be selected from any of a variety of suitable materials. The material may be selected according to the use for which the garment is intended (e.g., sporting or outdoor activities, travel, leisure, work, etc.). In some embodiments, it may be required that the material of the outer shell 140 is one or more of lightweight, breathable, moisture-wicking, stain-resistant, water-resistant, and combinations thereof. The material of the inner liner 120 and outer shell 140 may be washable, especially machine washable.

In some embodiments, the fabric used for the inner liner 120 may be made of a compressive material to apply more support and/or compression. In some embodiments, the inner liner 120, outer shell 140, or both may comprise a compressive material for support. In some embodiments, bonded materials, additional compressive materials, gripping surfaces, tabs, fasteners, reflective details, functional details, surface treatments to improve UVB, rain, snow, repellence, decorative details, or the like can be added to the inner liner 120 or the outer shell 140 or both. In some embodiments, a portion of the inner liner 120 or outer shell 140 or both can be constructed of a mesh type material providing breathability, visibility into a pocket, skin contact for a sensor, and/or additional advantages.

In some embodiments, the garment 100 is made of one or more materials, fibers, yarns, or fabric. In some embodiments, the material(s) is chosen based on type, stitch direction, thickness, weight, surface treatment, aesthetic properties, supporting breathability, moisture retention, moisture wicking, ultraviolet light (i.e., UV) protection, gripper surface, and/or stretch. In some embodiments, the inner liner 120 and outer shell 140 can be made of the same material(s). In other embodiments, the inner liner 120 and outer shell 140 can be made of different materials or different combinations of materials. In one embodiment, the inner liner 120 is made of a thinner material than the outer shell 140 for breathability. In one embodiment, the inner liner 120, the outer shell 140, or both the inner liner 120 and outer shell 140 can be made from a mesh material. In one embodiment, the inner liner 120 is made of a mesh material for breathability. In some embodiments, the garment 100 can be made from sun protective fabric, and the garment 100 is configured to provide UVB sun protection.

In some embodiments the material used for construction of the double panel 122 and the drawcord pouch 168 may be the same as the material used for the inner liner 120. In other embodiments the fabric used for the construction of the double panel 122 and the drawcord pouch 168 may be different than the fabric used for the inner liner 120.

It is also understood that the pocket(s) 130 described above may be constructed by a number of manufacturing processes, including but not limited to, folding, sewing, bonding, melting, adhesives, etc. These manufacturing techniques may be similar to, or different than, the techniques used to construct the rest of the garment incorporating the pocket structures.

While the pocket(s) 130 described above are configured to retain their contents by their geometry alone, it is further contemplated that the pocket structure openings may incorporate closure mechanisms configured to further secure the pocket structure contents. These closure mechanisms may include, but are not limited to, buttons, flaps, drawstrings, snaps, zippers, hook-and-loop fasteners, or embedded magnets.

According to an aspect, there is provided a lower body garment 100. The lower body garment 100 includes a waistband 110 configured to be positioned around a waist of a wearer, an inner liner 120 comprising a first pair of leg portions 126 having a first pair of bottom leg openings 128, a pocket 130 comprising a pocket bag, and an outer shell 140 comprising a top edge 142 and a body 144. The waistband 110 includes an upper edge 112 and a lower edge 114. The upper edge 112 of the waistband 110 defines a waist opening. The first pair of leg portions 126 covering a pelvic portion and a leg portion of the wearer. The first pair of leg portions 126 are configured to be positioned around legs of the wearer. An upper edge 124 of the inner liner 120 is attached to the lower edge 114 of the waistband 110. The pocket bag is formed by attaching a pocket panel 132 on at least one of the first pair of leg portions 126 of the inner liner 120. The pocket panel 132 includes at least one open edge 133 and at least one closed edge 134, 135, and 136. The at least one closed edge 134, 135, and 136 of the pocket panel 132 is attached to the inner liner 120 forming the pocket bag with a pocket opening 125 at the at least one open edge 133. At least a portion of the top edge 142 of the outer shell 140 is attached to at least a portion of the lower edge 114 of the waistband 110 and at least a portion of the upper edge 124 of the inner liner 120. The body 144 of the outer shell 140 includes a second pair of leg portions 146 having a second pair of bottom leg openings 148. The second pair of leg portions 146 covering the pelvic portion and the leg portion of the wearer. The body 144 of the outer shell 140 substantially engulfs a portion of the inner liner 120 covering the pelvic portion of the wearer. The second pair of leg portions 146 encase the first pair of leg portions 126, such that a portion of the inner liner 120 is visible at least at the pocket opening 125. The open edge 133 of the pocket panel 132 is attached to a portion of the top edge 142 of the outer shell 140 that is aligned with the pocket opening 125, such that the pocket 130 is accessible from the visible portion of the inner liner 120, via the pocket opening 125.

In some embodiments, the pocket bag is formed such that the pocket opening 125 is formed on at least one of the first pair of leg portions 126 and is proximate to the upper edge 124 of the inner liner 120.

In some embodiments, a diameter of each leg opening of the first pair of bottom leg openings 128 is smaller than a diameter of each leg opening of the second pair of bottom leg openings 148.

In some embodiments, the lower body garment 100 further includes an accessory loop 162 on the waistband 110 of the lower body garment 100.

In some embodiments, the lower body garment 100 further includes at least one pocket 164 and 166 located on the inside of a rear side 123 of the inner liner 120.

In some embodiments, the inner liner 120 is made of a mesh material.

In some embodiments, a length of the first pair of leg portions 126 is different from a length of the second pair of leg portions 146.

In some embodiments, a portion 122 above the pocket opening 125 is not engulfed by the outer shell 140.

In some embodiments, the portion 122 above the pocket opening 125 is made of at least two layers of fabric.

In some embodiments, the inner liner 120 is made of elastic mesh material.

In some embodiments, the inner liner 120 is made of a material that has a higher level of compressibility than a compressibility level of a material that the outer shell 140 is made of.

In some embodiments, the lower body garment 100 includes two pockets 130, one positioned on a left leg portion 126 and the other positioned on the right leg portion 126 of the first pair of leg portions 126.

In some embodiments, the pockets 130 are positioned on sides of each of the leg portions of the first pair of leg portions 126.

In some embodiments, the waistband 110 further includes a drawcord 160 positioned on an interior side of the waistband 110 for tensioning the waistband.

In some embodiments, the lower body garment 100 further includes a drawcord pouch 168 positioned on an interior side of the inner liner 120.

In some embodiments, the inner liner 120 further includes a pouch 168 positioned in the pelvic portion of the inner liner such that the drawcord 160 is inserted in the pouch 168 to keep it hidden.

In some embodiments, the lower body garment 100 is one or more of a short, pant, trouser, legging, cropped pant, skirt, or skort.

In some embodiments, the pocket 130 further includes a gripping surface formed on an inner surface of the pocket bag.

In some embodiments, the at least one closed edge 134, 135, and 136 includes a bottom edge 134 and opposing side edges 135 and 136 of the pocket panel 132 and the at least one open edge 133 comprises a top edge 133. The bottom edge 134 and opposing side edges 135 and 136 of the pocket panel 132 are attached to the inner liner 120 forming the pocket bag with an upward facing pocket opening 125.

While particular elements, embodiments and applications of the present disclosure have been shown and described, it will be understood, that the scope of the disclosure is not limited thereto, since modifications can be made by those skilled in the art without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another or may be combined in various ways. All possible combinations and sub combinations are intended to fall within the scope of this disclosure. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the inventions described herein.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

The invention claimed is:

1. A lower body garment comprising:

a waistband configured to be positioned around a waist of a wearer, the waistband comprising an upper edge and a lower edge, the upper edge of the waistband defining a waist opening;

an inner liner comprising a right portion and a left portion, the right portion including a right front panel, a right rear panel, a right side panel positioned between and attached to a lateral edge of the right front panel and a lateral edge of the right rear panel and a right leg portion having a right bottom leg opening, the left portion including a left front panel, a left rear panel, a left side panel positioned between and attached to a lateral edge of the left front panel and a lateral edge of the left rear panel and a left leg portion having a left bottom leg opening, the right portion and the left portion collectively configured to cover a pelvic portion and parts of respective legs of the wearer, the right leg portion and the left leg portion of the lower body garment configured to be positioned around the respective legs of the wearer, wherein an upper edge of the inner liner is attached to the lower edge of the waistband;

at least one pocket comprising a pocket bag, the pocket bag including a first pocket panel on an outer surface of at least one of the right side panel and the left side panel of the inner liner, the first pocket panel comprising at least one open edge and at least one closed edge, wherein the at least one closed edge of the first pocket panel is attached to the outer surface of the at least one of the right side panel and the left side panel of the inner liner, and the pocket bag includes a pocket opening at the at least one open edge; and an outer shell comprising a top edge and a body, wherein at least a portion of the top edge of the outer shell is attached to at least a portion of the lower edge of the waistband and at least a portion of the upper edge of the inner liner, and the body of the outer shell comprising a second pair of leg portions having a second pair of bottom leg openings, the second pair of leg portions are configured to cover the pelvic portion and the parts of the respective legs of the wearer, the body of the outer shell substantially engulfs a portion of the inner liner configured to cover the pelvic portion of the wearer, wherein the second pair of leg portions encase the right leg portion and the left leg portion, such that a visible portion of the inner liner is visible at least at a pocket access of the outer shell aligned with the pocket opening, wherein the open edge of the first pocket panel is attached to a portion of the outer shell aligned with the first pocket panel, such that the pocket is accessible from the visible portion of the inner liner, via the pocket opening.

2. The lower body garment of claim 1, wherein the pocket bag is formed such that the pocket opening is formed on at least one of the right leg portion and the left leg portion and is proximate to the upper edge of the inner liner.

3. The lower body garment of claim 1, wherein a diameter of each leg opening of the right bottom leg opening and the left bottom leg opening is smaller than a diameter of each leg opening of the second pair of bottom leg openings.

4. The lower body garment of claim 1, wherein the pocket access is substantially parallel to the waistband.

5. The lower body garment of claim 1 wherein the outer shell includes a right lateral edge and a left lateral edge, the right lateral edge of the outer shell aligns with the lateral edge of the right front panel of the inner liner, and the left lateral edge of the outer shell aligns with the lateral edge of the left front panel of the inner liner.

6. The lower body garment of claim 1, wherein the inner liner is made of a mesh material.

7. The lower body garment of claim 1, wherein a length of each of the right leg portion and the left leg portion is different from a length of the second pair of leg portions.

8. The lower body garment of claim 1, wherein the visible portion above the pocket opening is not engulfed by the outer shell.

9. The lower body garment of claim 8, wherein the visible portion above the pocket opening is made of at least two layers of fabric.

10. The lower body garment of claim 1, wherein the inner liner is made of elastic mesh material.

11. The lower body garment of claim 1, wherein the inner liner comprises an inner lining material and the outer shell comprises an outer shell material, and the inner lining material has a higher level of compression than the outer shell material.

12. The lower body garment of claim 1, wherein the at least one pocket comprises two pockets, and a first pocket of the two pockets is positioned on the left side panel and a second of the two pockets is positioned on the right side panel.

13. The lower body garment of claim 12, wherein the first pocket is positioned on a side of the left side panel and the second pocket is positioned on a side of the right side panel.

14. The lower body garment of claim 1, wherein the waistband further comprises a drawcord positioned on an interior side of the waistband for tensioning the waistband.

15. The lower body garment of claim 14, further comprising a drawcord pouch positioned on an interior side of the inner liner.

16. The lower body garment of claim 14, wherein the inner liner further comprises a pouch positioned in a pelvic portion of the inner liner such that the drawcord is insertable in the pouch to keep the drawcord hidden from exterior view.

17. The lower body garment of claim 1 wherein the at least one pocket further comprising a gripping surface formed on an inner surface of the pocket bag.

18. The lower body garment of claim 1, wherein the at least one closed edge comprises a bottom edge and opposing side edges of the first pocket panel and the at least one open edge comprises a top edge; wherein the bottom edge and opposing side edges of the first pocket panel are attached to the inner liner forming the pocket bag with the pocket opening in an upward facing orientation.

19. The lower body garment of claim 1, wherein the pocket access extends between the lateral edge of the right front panel and the lateral edge of the right rear panel of the inner liner, or between the lateral edge of the left front panel and the lateral edge of the left rear panel of the inner liner.

* * * * *